US007462582B2

(12) United States Patent
Komiyama et al.

(10) Patent No.: US 7,462,582 B2
(45) Date of Patent: Dec. 9, 2008

(54) WATERBORNE COMPOSITION FOR FORMING PROTECTIVE COATINGS

(75) Inventors: Shinobu Komiyama, Kanagawa Pref. (JP); Hidehiro Yamaguchi, Kanagawa Pref. (JP); Akihiro Seo, Kanagawa Pref. (JP)

(73) Assignee: Henkel AG & Co. KGaA, Dusseldorf (DE)

( * ) Notice: Subject to any disclaimer, the term of this patent is extended or adjusted under 35 U.S.C. 154(b) by 157 days.

(21) Appl. No.: 10/364,732

(22) Filed: Feb. 11, 2003

(65) Prior Publication Data

US 2003/0130139 A1 Jul. 10, 2003

Related U.S. Application Data

(63) Continuation of application No. PCT/JP01/06961, filed on Aug. 13, 2001.

(30) Foreign Application Priority Data

Aug. 11, 2000 (JP) ..... 2000-244305

(51) Int. Cl.
*C10M 125/00* (2006.01)
*C10M 125/30* (2006.01)
*C10M 173/00* (2006.01)

(52) U.S. Cl. ..... 508/136; 508/137; 508/138; 508/141; 508/143; 508/154; 508/155; 508/161; 508/165; 508/181

(58) Field of Classification Search ..... 508/136, 508/137, 138, 141, 143
See application file for complete search history.

(56) References Cited

U.S. PATENT DOCUMENTS

| | | | | | |
|---|---|---|---|---|---|
| 4,425,244 | A | * | 1/1984 | House | 508/143 |
| 4,435,296 | A | * | 3/1984 | Brooks et al. | 508/137 |
| 4,683,259 | A | * | 7/1987 | Goodman | 524/447 |
| 5,307,660 | A | * | 5/1994 | Stoutenburg | 72/42 |
| 5,661,116 | A | * | 8/1997 | Periard | 508/126 |
| 5,663,111 | A | * | 9/1997 | Gadberry et al. | 501/146 |
| 5,939,475 | A | * | 8/1999 | Reynolds et al. | 524/230 |
| 6,130,256 | A | * | 10/2000 | Nae | 516/34 |
| 6,136,757 | A | * | 10/2000 | Chiddick | 508/126 |
| 6,172,121 | B1 | * | 1/2001 | Chaiko | 516/101 |
| 6,251,839 | B1 | * | 6/2001 | Faci | 508/116 |

OTHER PUBLICATIONS

The Clay Handbook, 2nd Edt., Clay Science Society of Japan, 1987 pp. 58-66.

* cited by examiner

*Primary Examiner*—Ellen M. McAvoy
(74) *Attorney, Agent, or Firm*—Mary K. Cameron

(57) ABSTRACT

A waterborne composition for forming protective coatings to provide, by a simple method comprising coating and drying onto a metal surface, a coating that is uniform with little unevenness and that has an excellent galling resistance and workability that are at least as good as the corresponding properties afforded by conversion treatment methodologies, contains water-soluble inorganic salt and smectite-type clay mineral. The lubrication performance of the coating can also be improved when said composition additionally contains a lubricating component.

15 Claims, No Drawings

WATERBORNE COMPOSITION FOR FORMING PROTECTIVE COATINGS

CROSS REFERENCE TO RELATED APPLICATIONS

This application is a continuation of International Application Number PCT/JP01/06961, published in a non-English language, having an international filing date of Aug. 13, 2001, and claims priority thereto and claims priority to JP 2000-244305 filing date Aug. 11, 2000.

FIELD OF THE INVENTION

This invention relates to a waterborne composition for forming protective coatings (hereinafter referred to as a protective coating-forming waterborne composition). More particularly, this invention relates to a protective coating-forming waterborne composition that is used to form a protective coating on the surface of a metal (e.g., iron, steel, stainless steel, aluminum, magnesium, tin, titanium, etc.) that will be submitted to cold plastic working, wherein said protective coating provides an improved workability and an improved resistance to galling.

BACKGROUND OF THE INVENTION

A protective coating layer is formed on the surface of the workpiece in the plastic working of metals with the goal of preventing galling by avoiding direct metal-to-metal contact between the workpiece and tool. Various protective coating layers have been used to date. One method in general use involves the formation of, for example, an oil film, soap film, metal soap film, or wax film, either as such or in combination with a binder component. Another widespread method comprises the formation of a coating of a lubricating component on a reactive conversion coating layer (for example, a phosphate coating or oxalate coating) already formed on the metal surface. In the case of the former method, the protective coating layer formed directly on the workpiece surface not only prevents direct metal-to-metal contact, but through its lubricating properties also reduces the coefficient of friction of the workpiece surface. This enables a reduction in the working energy through a relaxation of the load on the protective film layer itself and a relaxation of heat production by the working process. The protective coating can be formed in this technology by dissolving or dispersing the lubricating component in water, either by itself or together with a binder component as necessary or desired, and coating and drying the resulting bath on the workpiece surface. This process therefore offers the advantages of a low number of process steps and easy bath management. However, within the sphere of the severe working sector with its high degree of working, the protective coating layer is unable to follow the enlargement in the surface area of the workpiece and an acceptable performance by the protective film is frequently not secured due to an extreme thinning of the film as well as the generation of open areas in the film.

In the case of the latter method, direct contact between the tool and workpiece is avoided through the formation of a fine and dense reactive conversion coating layer on the workpiece surface. A coating of lubricating component is generally also placed on the surface of this conversion coating. Because the adherence and retention of the lubricating component layer is excellent in this case due to the surface roughness, this technology can also be used in severe working environments since the surface enlargement due to working can be satisfactorily followed. However, the conversion coating is elaborated by a chemical reaction, which necessary entails a complex procedure for managing the treatment bath and a large number of steps in addition to a high cost when capital and wastewater treatment expenses are included. In addition, the chemical reactivity varies substantially as a function of the target material, and the application of conversion treatment to a conversion-resistant, weakly reactive material in particular stands little chance of success.

In order to solve the problems identified above, efforts have been made to improve the properties of the protective films afforded by the former method up to a level equivalent to that of the protective films afforded by conversion treatment. These efforts have resulted in the introduction of methods that use oil-based lubricants and methods that use water-based lubricants. Within the sphere of the oil-based lubricants, Japanese Published (Examined or Kokoku or B) Patent Application Number Hei 4-1798 (1,798/1992) discloses a "cold-working lubricant afforded by blending a metal soap or solid lubricant into a lubricating oil comprising a blend of extreme-pressure agent (e.g., chlorinated paraffin, phosphate ester), isobutylene/n-butene copolymer, and animal or vegetable oil". While this is a high-performance lubricant, it is nevertheless associated with several problems: it provides a workability somewhat poorer than that provided when lubrication is effected by carrying out a reactive soap lubrication treatment on top of a conversion coating treatment, and it generates an unpleasant odor during the working process due to its use of the extreme-pressure additive.

The water-based lubricants can be used directly in a wet process or can be used as dried coatings in a dry process. Water-based lubricants that are used directly in a wet process are, like the aforementioned oil-based lubricants, directly flowed onto the workpiece or tool. In the case of water-based lubricants that are used as dried coatings, a solid coating is obtained, just as for the aforementioned conversion coating, by immersion in a treatment bath followed by evaporation of the water fraction in a drying step. Japanese Published (Examined or Kokoku or B) Patent Application Number Sho 58-30358 (30,358/1983) discloses a water-based lubricant of the first type in the form of a "lubricant for the hot-working of metal tubing, comprising a bicarbonate (solid) main component to which small amounts of dispersant, surfactant, and solid lubricant have been added". This lubricant, however, has not yet achieved widespread use in place of conversion coating treatments. An example of the second type of water-based lubricant is disclosed in Japanese Laid-Open (Unexamined or Kokai or A) Patent Application Number Sho 52-20967 (20,967/1977) in the form of a "lubricant composition comprising solid lubricant, a conversion coating-forming agent, and a base of water-soluble polymer or water-based emulsion thereof". This lubricant, however, does not match conversion coating treatments.

More recently, Japanese Laid-Open (Unexamined or Kokai or A) Patent Application Number 2000-63680 has disclosed a lubricating agent composition for the plastic working of metals that contains synthetic resin and water-soluble inorganic salt in specific proportions. This lubricating agent composition prevents direct metal-to-metal contact with the tool through the formation of a coating comprising the synthetic resin and water-soluble inorganic salt uniformly precipitated on the workpiece surface. In addition, the presence in the coating of a lubricating component in a freely selected proportion provides a performance at least as good as that afforded by the formation of a lubricating component layer on a phosphate coating. In the case of the composition under discussion, however, a single coating composed of the aforementioned chemicals carries the dual functions of galling resistance and lubricity. As a consequence, coating defects and extreme differences in the quantity adhered arising from uneven add-on during, for example, the coating process, can easily become starting points for the occurrence of galling. Since this is a fatal flaw, coating uniformity becomes a crucial feature, yet this consideration has received no attention.

SUMMARY OF THE INVENTION

This invention is intended to solve the problems identified above for the prior art. In specific terms, the object of this invention is to introduce a waterborne composition for forming a protective coating on metals, wherein said composition is waterborne and can form—by a simple method comprising application by, e.g., immersion or spraying, followed by drying —a coating that is uniform with little unevenness and that provides an excellent workability and galling resistance that are at least equal to the workability and galling resistance provided by conversion treatment methods.

In one embodiment, the invention is a waterborne composition for forming protective coatings that characteristically contains water-soluble inorganic salt and smectite-type clay mineral. Preferably the mass ratio of water-soluble inorganic salt to smectite-type clay mineral is 1:1 to 1:0.01.

Preferably the water-soluble inorganic salt is at least one selection from the group consisting of the sulfates, borates, silicates, molybdates, vanadates, and tungstates and the smectite-type clay mineral is at least one selection from the group consisting of montmorillonite, sauconite, beidellite, hectorite, nontronite, saponite, iron saponite, and stevensite.

In another embodiment, the above-described composition further comprises 1-70 mass % lubricating component. Examples of lubricating components include at least one selection from oils, soaps, metal soaps, waxes, and polytetrafluoroethylene, wherein the basis for calculation of the mass % is the sum of the water-soluble inorganic salt, smectite-type clay mineral, and lubricating component.

A preferred embodiment comprises a waterborne composition for forming protective coatings comprising a water-soluble inorganic salt, a smectite-type clay mineral and 1-70 mass % lubricating component, wherein the basis for calculation of the mass % is the sum of the water-soluble inorganic salt, smectite-type clay mineral, and lubricating component, wherein the mass ratio of water-soluble inorganic salt to smectite-type clay mineral is 1:1 to 1:0.01.

Another aspect of the invention comprises metal that bears a protective coating that has been produced by coating and drying a composition according to the invention on the metal. Examples of suitable metals include iron, steel, copper, copper alloy, aluminum, aluminum alloy, titanium, titanium alloy, magnesium, magnesium alloy, tin, or tin alloy.

The invention is also directed to a method of forming a uniform protective coating on a metal workpiece, comprising the steps of degreasing the metal workpiece, water-rinsing the metal workpiece, applying a waterborne composition comprising a water-soluble inorganic salt and a smectite-type clay mineral; and drying the composition on the workpiece.

Another embodiment provides a method of forming a lubricant coating for use in the plastic working of metals on a metal workpiece comprising the steps of degreasing the metal workpiece, water-rinsing the metal workpiece, applying a waterborne composition comprising a water-soluble inorganic salt, a smectite-type clay mineral and 1-70 mass % lubricating component, wherein the basis for calculation of the mass % is the sum of the water-soluble inorganic salt, smectite-type clay mineral, and lubricating component; and drying the composition on the workpiece.

The foregoing methods may employ lubricating component comprising at least one selection from the group consisting of oils, soaps, metal soaps, waxes, and polytetrafluoroethylene. Examples of the metal coated using these methods are iron, steel, copper, copper alloy, aluminum, aluminum alloy, titanium, titanium alloy, magnesium, magnesium alloy, tin, or tin alloy.

DETAILED DESCRIPTION OF A PREFERRED EMBODIMENT

As a result of intensive research directed to solving the problems identified above, the inventors discovered that a very highly adherent, blemish-free, uniform, highly heat-resistant, very tough, and galling-resistant protective coating is obtained when a water-based bath containing water-soluble inorganic salt and smectite-type clay mineral is coated and dried on a metal. The inventors also discovered that the presence of a lubricating component in this water-based bath could provide the resulting coating with an excellent self-lubricating capacity. This invention was achieved based on these discoveries.

This invention therefore specifically relates to a protective coating-forming waterborne composition that characteristically contains water-soluble inorganic salt and smectite-type clay mineral. This composition contains water-soluble inorganic salt, smectite-type clay mineral, and water wherein the smectite-type clay mineral is colloidally dispersed in an aqueous solution of the water-soluble inorganic salt. The coating afforded by the protective coating-forming waterborne composition of this invention exhibits an excellent galling resistance when used as an undercoating primarily for conventional oil-based lubricating films. However, it can be made into a self-lubricating protective coating by the presence of 1-70 mass % lubricating component comprising at least one selection from oils, soaps, metal soaps, waxes, and polytetrafluoroethylene, wherein the basis for calculation of the mass % is the sum of the water-soluble inorganic salt, smectite-type clay mineral, and lubricating component. The mass ratio of water-soluble inorganic salt to smectite-type clay mineral is preferably 1:1 to 1:0.01, and the water-soluble inorganic salt is preferably at least one selection from the sulfates, borates, silicates, molybdates, vanadates, and tungstates.

The smectite-type clay mineral used in the protective coating-forming waterborne composition of this invention is a clay mineral with the following general formula as described in *The Clay Handbook*, *2nd Edition* (in Japanese), edited by the Clay Science Society of Japan, published by Gihodo Shuppan Co., Ltd., 1987, pages 58-66:

$$X_m(Y^{2+},Y^{3+})_{2-3}Z_4O_{10}(OH)_2\cdot nH_2O$$

wherein

X is at least one selection from K, Na, ½Ca, and ½Mg, m is 0.25 to 0.6, $Y^{2+}$ is at least one selection from Mg, $Fe^{2+}$, $Mn^{2+}$, Ni, Zn, and Li, $Y^{3+}$ is at least one selection from Al, $Fe^{3+}$, $Mn^{3+}$, and $Cr^{3+}$, Z is at least one selection from Si and Al, and $nH_2O$ is the interlayer water.

The $Y^{2+}$, $Y^{3+}$ in ($Y^{2+}$, $Y^{3+}$) denotes $Y^{2+}$ and/or $Y^{3+}$, while X represents the interlayer cations, Y represents the octahedral cations, and Z represents the tetrahedral cations.

The smectite-type clay mineral used by this invention can be specifically exemplified by montmorillonite, sauconite, beidellite, hectorite, nontronite, saponite, iron saponite, and stevensite.

The particles of smectite-type clay minerals are generally small and hence exhibit an excellent capacity to form thin films. The smectite-type clay minerals occur naturally, but can also be obtained as synthetic products. This invention can use either the natural or synthetic product, but in general use of the synthetic product is preferred when the goal is formation of a thin film since the synthetic products can be obtained in smaller particle sizes. Hectorite is preferred among the smectite-type clay minerals for its generally smaller particle size. While both natural and synthetic hectorite are available, synthetic hectorite is the more preferred material for its generally smaller particle size.

The smectite-type clay minerals have a layer structure. The individual layers of the crystal structure in this layer structure are formed by the assembly of two-dimensional platelets (=primary particles) that have a thickness of approximately 1 nm. Some fraction of the magnesium and aluminum atoms present in the platelet unit are isomorphically replaced by cation atoms of lower valence, and as a result the platelet unit carries a negative charge. This negative charge is balanced in the dry state by exchangeable cations residing outside the lattice structure of the plate face. In the solid phase these particles are bonded to each other by van der Waals forces to form an aggregate of plates. When a smectite-type clay mineral is dispersed in an aqueous phase, the exchangeable cations become hydrated and the particles swell. A stable sol can be obtained by carrying out dispersion using a standard dispersing device such as a high-speed dissolver. In this state of dispersion in an aqueous phase, the surface of the platelets have a negative charge, which results in electrostatic repulsion among the platelets and the generation of a sol microdivided to the level of the platelet-shaped primary particles. The dispersed material in an aqueous dispersion of a smectite-type clay mineral is thought to be the two-dimensional platelets (thickness=approximately 1 nm), that is, square or disk-shaped plates wherein a side or diameter of the plate face is 20 to 500 nm. Synthetic hectorite whose primary particle is a disk-shaped particle having a thickness of approximately 1 nm and a diameter of 20-40 nm is commercially available.

The protective coating-forming waterborne composition of this invention exhibits an excellent coating performance, and its viscosity behavior is a factor that governs its coating performance. Organic polymer thickeners are generally known as viscosity regulators for waterborne compositions. The organic polymer thickeners can be exemplified by hydroxyethylcellulose, carboxymethylcellulose, polyacrylamide, sodium polyacrylate, polyvinylpyrrolidone, and polyvinyl alcohol. However, when used in concentrated aqueous inorganic salt solutions, these organic polymer thickeners frequently do not exhibit an acceptable thickening activity or suffer from a decline in thickening activity with elapsed time at elevated temperature due to modification. Finely divided silica, bentonite, kaolin, etc., are known as inorganic thickeners. These inorganic thickeners are used in order to impart thixotropy, but they are ordinarily used in combination with an organic polymer thickener since the inorganic thickeners all exhibit a pronounced tendency to settle because they have higher specific gravities than the water used as solvent. However, since for the reasons provided above it is quite difficult to use an organic polymer thickener in a waterborne composition containing concentrated inorganic salt, the end result is that an inorganic thickener also cannot be used. As a consequence, the development of a usable viscosity regulator has been desired.

When the smectite-type clay mineral used by this invention is dispersed in an aqueous phase, the exchangeable cations, supra, undergo hydration and the particles swell and become separated into platelets. When dispersed in an aqueous phase, the platelets have a negative surface charge, but a positive edge charge. Under conditions in which the negative surface charge is significantly larger than the positive edge charge, electrical repulsion between negatively charged platelet surfaces generates a stable sol in which dispersion occurs to the primary particle level. However, when the particle concentration or ion concentration is increased, the repulsive force due to the negative surface charge is reduced and the platelet edges, which are positively charged, can become electrically oriented on the negatively charged surfaces of other platelets to form a so-called house-of-cards structure, resulting in the development of both a thickening activity and thixotropy. Since bonding in this house-of-cards structure is due to electrical attraction, the dispersion exhibits structural viscosity in the low shear region. The manifestation of the excellent thixotropy is thought to be due to separation of the bonding in the high shear region with conversion to a sol state.

The primary particles of synthetic hectorite, a member of the smectite-type clay minerals, are two-dimensional platelets approximately 1 nm thick, that is, square or disk-shaped microplates wherein the side or diameter of the plate face is extremely small at 20-40 nm. In addition, the platelets have a negatively charged surface and form a stable sol in the aqueous phase due to electrostatic repulsion. As a consequence of these features settling of the particles substantially does not occur even in the absence of an organic polymer thickener. For this reason the smectite-type clay minerals can exhibit an appropriate thixotropy when colloidally dispersed in the waterborne composition of this invention, which results in a substantially improved coatability that yields the formation of a uniform coating that presents few film defects and little unevenness in amount of application.

The smectite-type clay mineral present uniformly dispersed in the protective coating-forming waterborne composition of this invention provides additional positive effects as follows: it improves the galling resistance by improving the strength of the inorganic salt coating afforded by application and drying, and it improves the corrosion resistance of the workpiece by a barrier activity that slows the rate of moisture diffusion into the coating.

The water-soluble inorganic salt used in the protective coating-forming waterborne composition of this invention is the central coating film component in the inventive composition. It functions to prevent direct metal-to-metal contact between the workpiece and tool by forming a solid, continuous coating on the metal surface and it also functions to hold other blended components—most importantly any lubricating components—in the coating. Moreover, since the melting point of the coating comprising this water-soluble inorganic salt is usually higher than the temperature attained by the stock during cold plastic working, the above-referenced functionalities will be stable and a lubricating coating layer based on this water-soluble inorganic salt will be little influenced by the heat generated by the working process.

At least one selection from the group consisting of salts of sulfuric acid, salts of boric acid, salts of silicic acid (not only salts of orthosilicic acid $H_4SiO_4$, but also salts of metasilicic acid $H_2SiO_3$ and salts of polysilicic acids such as pyrosilicic acid (orthodisilicic acid) $H_6Si_2O_7$, mesodisilicic acid $H_2Si_2O_5$, and tetrasilicic acid $H_2Si_4ZO_9$), molybdates, vanadates, and tungstates is preferably used as water-soluble inorganic salt with the properties identified above. Among these water-soluble inorganic salts, the use of at least one selection from salts of sulfuric acid, salts of boric acid, and salts of silicic acid is preferred. The cation in these acid salts can be exemplified by alkali metal ions, the ammonium ion, and cations generated from amines (amine salts as the salt). The water-soluble inorganic salt can be specifically exemplified by sodium sulfate, potassium sulfate, sodium borate (such as sodium tetraborate), potassium borate (such as potassium tetraborate), ammonium borate (such as ammonium tetraborate), sodium silicate, potassium silicate, lithium silicate, ammonium molybdate, sodium molybdate, sodium tungstate, and sodium vanadate. These may be used singly or in combinations of two or more selections.

The water-soluble inorganic salt: smectite-type clay mineral mass ratio in this invention is preferably 1:1-1:0.01 and more preferably is 1:0.5-1:0.03. A smectite-type clay mineral-to-water-soluble inorganic salt mass ratio in excess of 1 results in a decline in the adherence and ability to follow or track the working process (hereinafter referred to as the conformability) and hence in a pronounced tendency for the coating to delaminate during working and for galling to occur. At a smectite-type clay mineral-to-water-soluble inorganic salt mass ratio below 0.01, the inventive waterborne composition is unable to manifest thixotropy and a uniform appearance is not obtained.

The inventive protective coating-forming waterborne composition may also contain a lubricating component as necessary or desired, and the presence of a lubricating component in the inventive composition is generally preferred. This lubricating component should be stable in the aqueous bath and should not impair the strength of the coating. Lubricating components with these properties can be exemplified by soaps, metal soaps, waxes, polytetrafluoroethylene, and oils. The soaps can be specifically exemplified by sodium stearate, potassium stearate, and sodium oleate; the metal soaps can be specifically exemplified by calcium stearate, magnesium stearate, aluminum stearate, barium stearate, lithium stearate, zinc stearate, and calcium palmitate; the waxes can be specifically exemplified by polyethylene waxes, polypropylene waxes, carnauba wax, beeswax, and paraffin wax; and the polytetrafluoroethylene can be specifically exemplified by polytetrafluoroethylenes with degrees of polymerization of about 1,000,000 to 10,000,000. Vegetable oils, mineral oils, and synthetic oils can be used as the oil. The vegetable oils can be exemplified by palm oil, castor oil, and rapeseed oil; the mineral oils can be exemplified by machine oil, turbine oil, and spindle oil; and the synthetic oils can be exemplified by ester oils and silicone oils. The lubricating component is preferably introduced into the inventive composition by mixing its water-based dispersion or water-based emulsion with the other components. The lubricating component will usually be present dispersed or emulsified in the inventive composition.

The lubricating component is present preferably at 1-70 mass % and more preferably at 5-55 mass %, wherein the basis for calculation of the mass % is the sum of the water-soluble inorganic salt, smectite-type clay mineral, and lubricating component. A lubricating component content less than 1 mass % results in high friction by the coating and, when the coating is used by itself as a self-lubricating coating, in a pronounced tendency for galling to occur. A content in excess of 70 mass % causes the adherence and strength of the coating to decline. However, an excellent galling resistance can be obtained, even when absolutely no lubricating component is present in the inventive composition, by first elaborating a coating comprising the inventive waterborne composition and then coating an oil or other lubricating agent thereon.

The inventive composition can also contain a solid lubricant in the case of severe plastic working operations. The solid lubricant used in such cases should be stable when present in the coating and should function to assist lubrication at high loads. Solid lubricants of this type can be exemplified by graphite, molybdenum disulfide, boron nitride, graphite fluoride, and mica.

The inventive composition can also contain an extreme-pressure additive in the case of severe plastic working operations. The extreme-pressure additive used in such cases should be stable when present in the coating and should exhibit extreme-pressure activity at the tool/metal contact surface during the working operation. Extreme-pressure additives of this type can be exemplified by sulfur extreme-pressure additives, organomolybdenum extreme-pressure additives, phosphorus extreme-pressure additives, and chlorine extreme-pressure additives, for example, sulfurized olefins, sulfurized esters, sulfites, thiocarbonates, chlorinated fatty acids, phosphate esters, phosphite esters, molybdenum dithiocarbamates (MoDTC), molybdenum dithiophosphates (MoDTP), and zinc dithiophosphates (ZnDTP).

In those cases where a dispersant is necessary in order to disperse or emulsify the lubricating component, solid lubricant, and/or extreme-pressure additive, said dispersant can be selected from the nonionic surfactants, anionic surfactants, amphoteric surfactants, cationic surfactants, and water-soluble polymeric dispersants.

The method for producing the protective coating-forming waterborne composition according to this invention is not critical, as long as the resulting waterborne composition satisfies the conditions set out hereinabove. As an example, the inventive composition can be prepared by adding a water-based dispersion of smectite-type clay mineral to an aqueous solution of the water-soluble inorganic salt with thorough stirring, followed by the addition with stirring of any optional components, i.e., the lubricating component, solid lubricant, and/or extreme-pressure additive, as necessary formulated as a dispersion or emulsion using dispersant and water.

The inventive waterborne composition can be used to form a uniform protective coating on a metal such as iron, steel, copper, copper alloy, aluminum, aluminum alloy, titanium, or titanium alloy, or can be used as a lubricant for use during the cold plastic working (e.g., wire drawing, tube drawing, forging) of the above-listed metals. The shape of the metal is not critical, and one can contemplate application to the working of not only stock such as bar or block, but also shaped material (e.g., gears, shafts) after hot forging.

The surface of the metal workpiece is preferably cleaned prior to application of the inventive waterborne composition in order to secure good results. This cleaning preferably comprises a pretreatment, in the given sequence, of degreasing (using the usual alkaline degreasers), a water rinse, pickling (carried out using, for example, hydrochloric acid, in order to remove the oxide scale on the workpiece and improve adherence by the coating), and a water rinse. The pickling→water rinse can be omitted when no oxide scale is present. These pretreatments can be carried out using the usual methods.

The waterborne composition according to this invention can be applied to metals by the usual methods, such as immersion, spraying, flow coating, and electrostatic coating. The application time is not critical as long as the metal surface becomes thoroughly coated with the waterborne composition. The waterborne composition must be dried after its application. Drying may be carried out by standing at ambient temperature, but is ordinarily best carried out at 60 to 150° C.

for 10 to 60 minutes. The coating weight after application and drying of the waterborne composition is preferably at least 1 $g/m^2$ considered from the perspective of galling prevention, but preferably is no greater than 50 $g/m^2$ based on cost considerations. Weights of 5-30 $g/m^2$ are particularly preferred.

The excellent galling resistance afforded by the inventive protective coating-forming waterborne composition is due to the formation of a composite coating of the water-soluble inorganic salt and smectite-type clay mineral. The smectite-type clay mineral is thought to improve the strength of the coating by functioning as a skeleton or framework for the water-soluble inorganic salt film, and to also minimize the damage caused by the heat of the working operation since it is a highly heat-resistant inorganic coating. In addition, it is necessary that the inventive waterborne composition exhibit a very uniform coating behavior, which arises from the fact that it forms the protective coating by application and drying on the workpiece surface. Due—based on the presence of the smectite-type clay mineral—to an appropriate level of thixotropy and the abrupt manifestation of structural viscosity in the drying/concentration step, the liquid film coated on the workpiece surface converts into a uniform coating film free of unevenness and the aggregation of dispersed particles (originating, for example, from the dispersion of a lubricating component in the inventive waterborne composition) during drying/concentration is inhibited. The result is the production of a coating film that exhibits stable properties and a high degree of component uniformity.

This invention and its advantageous effects are explained in specific detail through illustrative examples of this invention and comparative examples. The following Examples are presented as specific illustrations of the claimed invention. It should be understood, however, that the invention is not limited to the specific details of the Examples.

EXAMPLES

Examples 1-10 and Comparative Examples 1-5

Protective coating-forming waterborne compositions were prepared using the components and proportions reported in Table 1.

Tests

Test Specimens

Attachment tests: SUS304, 20 mm×100 mm×1.2 mm

Spike tests: spheroidized S45C, diameter=25 mmØ, height=30 mm

Coating Formation

Coatings were formed using the following treatment sequences.

The following treatment sequence was used in Examples 1-10 and Comparative Examples 1-4:

1. degreasing: commercial degreaser (FINECLEANER 4360, registered trade mark of Nihon Parkerizing Co., Ltd.), concentration=20 g/L, temperature=60° C., immersion for 10 minutes
2. water rinse: tap water, 60° C., immersion for 30 seconds
3. surface treatment: treatment agent according to the particular illustrative or comparative example, 60° C., immersion for 10 seconds, dry add-on of intended material=5 $g/m^2$
4. drying: 80° C., 3 minutes The following treatment sequence was used in Comparative Example 5:

1. degreasing: commercial degreaser (FineCleaner 4360, registered trade mark of Nihon Parkerizing Co., Ltd.), concentration=20 g/L, temperature=60° C., immersion for 10 minutes
2. water rinse: tap water, room temperature, immersion for 30 seconds
3. conversion treatment: commercial zinc phosphate conversion treatment agent (Palbond 181X, registered trademark of Nihon Parkerizing Co., Ltd.), concentration=90 g/L, temperature=80° C., immersion for 10 minutes, dry add-on of intended material=5 $g/m^2$
4. water rinse: tap water, room temperature, immersion for 30 seconds
5. soap treatment: commercial reactive soap lubricant (PALUBE 235, registered trademark of Nihon Parkerizing Co., Ltd.), concentration=70 g/L, temperature=80° C., immersion for 5 minutes, dry add-on of intended material=5 $g/m^2$
6. drying: 80° C., 3 minutes Testing Coatability The coatability was evaluated visually after formation of the coating as described above. The evaluation scale is given below.

A: uniform, no unevenness in application

B: slight unevenness in application

C: uneven application, the coating is extremely thin at some locations

D: distinctly uneven application, no coating is present in some locations

Spike Test

A spike test was carried out based on the description in Japanese Laid-Open (Unexamined or Kokai or A) Patent Application Number Hei 5-7969 (7,969/1993). The lubrication performance was evaluated based on the spike height after the test and the forming load. A higher spike height is indicative of a better lubrication performance in this test.

Conformability

The extent to which the coating followed the protruded element of the test specimen was visually evaluated after the spike test. The scale used for evaluation is given below.

A: the coating followed to the top of the protrusion

B: the coating followed to the middle of the protrusion

C: the coating followed to the bottom of the protrusion

D: the coating did not follow onto the protruded element

The results of the preceding tests are reported in Table 1. As the results in Table 1 make clear, the coatings formed on the test specimens using the compositions of Examples 1-10 (protective coating-forming waterborne compositions according to this invention) gave an excellent coatability (related to a uniform attachment of the coating) and an excellent conformability and also an excellent lubrication performance. Comparative Examples 1-4, which lacked smectite-type clay mineral, gave a good lubricity, but still had problems with uniformity and conformability, which would lead to instability in industrial use. Comparative Example 5 involved the execution of a reactive soap treatment on a phosphate coating. While Comparative Example 5 gives a lubrication performance about equal to that of the invention, it requires wastewater treatment and bath management and cannot be implemented using a simple equipment set up. Moreover, the waste produced accompanying the reaction imposes a heavy environmental load.

TABLE 1

| | Examples 1-10 and Comparative Examples 1-5 | | | | | | | | | |
|---|---|---|---|---|---|---|---|---|---|---|
| | | | lubricating | | | | evaluation results | | | |
| | | | lubricating component 1 | | component 2 | | | | spike | |
| | water-soluble inorganic salt | mass ratio (*1) | name | mass % (*6) | name | mass % (*6) | no. of steps | coat-ability | height (mm) | conform-ability |
| | | | | Examples | | | | | | |
| 1 | potassium sulfate sodium metasilicate (*2) | 1:0.5 | polyethylene wax | 10.0 | palm oil | 8.0 | 4 | A | 13.1 | B |
| 2 | sodium silicate | 1:0.05 | polyethylene wax | 40.0 | Ca stearate | 5.0 | 4 | A | 13.2 | B |
| 3 | potassium tetraborate | 1:0.15 | polyethylene wax | 20.0 | — | — | 4 | A | 13.2 | A |
| 4 | sodium tungstate | 1:0.8 | paraffin wax | 5.0 | — | — | 4 | B | 13.1 | B |
| 5 | sodium molybdate | 1:0.1 | paraffin wax | 15.0 | Na stearate | 20.0 | 4 | A | 13.0 | A |
| 6 | sodium vanadate | 1:0.5 | paraffin wax | 10.0 | — | — | 4 | A | 13.0 | B |
| 7 | sodium tetraborate | 1:0.03 | paraffin wax | 20.0 | Na stearate | 5.0 | 4 | B | 12.6 | B |
| 8 | lithium borate | 1:0.2 | PTFE (*4) | 50.0 | Ba stearate | 5.0 | 4 | B | 11.7 | B |
| 9 | sodium tungstate | 1:0.5 | — | — | — | — | 4 | B | 11.0 | B |
| 10 | sodium molybdate | 1:0.15 (*3) | polyethylene wax | 40.0 | Ca stearate | 5.0 | 4 | B | 13.0 | B |
| | | | | comparative examples (*5) | | | | | | |
| 1 | potassium tetraborate | — | polyethylene wax | 30.0 | Ca stearate | 5.0 | 4 | C | 13.1 | B |
| 2 | sodium vanadate | — | paraffin wax | 20.0 | — | — | 4 | C | 12.9 | C |
| 3 | sodium metasilicate | — | — | — | — | — | 4 | C | 11.0 | D |
| 4 | sodium tungstate | — | polyethylene wax | 5.0 | — | — | 4 | C | 10.2 | C |
| 5 | zinc phosphate treatment | | reactive soap lubrication treatment | | | | 6 | B | 12.8 | B |

Note 1. water-soluble inorganic salt:smectite-type clay mineral (synthetic hectorite) mass ratio
Note 2. potassium sulfate:sodium metasilicate = 7:3
Note 3. water-soluble inorganic salt:synthetic hectorite (70 mass %) + CMC (30 mass %)
Note 4. PTFE:polytetrafluoroethylene
Note 5. Comparative Examples 1-4 did not use a smectite-type clay mineral, but used an organic polymer thickener (CMC) as the viscosity regulator. water-soluble inorganic salt: CMC mass ratio = 1:0.3
Note 6. % calculated on the sum of the water-soluble inorganic salt, smectite-type clay mineral, and lubricating component. The proportions of the water-soluble inorganic salt and smectite-type clay mineral are obtained by distributing, using Example 1 as an example, 82 mass % in accordance with the mass ratio.
Note 7. In order to evaluate use as a carrier, a mineral oil was applied in Example 9 and Comparative Example 3. The mineral oil was machine oil and was applied at 100 g/m$^2$.
Note 8. In Examples 1-10 and Comparative Examples 1-4, the sum of the water-soluble inorganic salt, smectite-type clay mineral, and lubricating component was 10 mass %; ion-exchanged water was used for the remainder.

As the preceding explanation has made clear, a uniform, galling-resistant protective coating evidencing little unevenness can be formed by a simple method comprising application of the protective coating-forming waterborne composition of this invention to the target metal followed by drying. In addition, the presence of an optional lubricating component provides a coating that has a lubrication performance superior to or at least equal to that of prior-art phosphate treatments. Moreover, little waste is generated and the working environment is excellent, making the inventive composition extremely advantageous from an industrial or commercial standpoint.

Although the invention has been described with reference to preferred embodiments, it is to be understood that variations and modifications may be resorted to as will be apparent to those skilled in the art. Such variations and modifications are to be considered within the purview and scope of the claims appended hereto.

The invention claimed is:

1. A waterborne composition comprising;

a.) water;

b.) a water-soluble inorganic salt selected from sulfates, borates, silicates, molybdates, vanadates, and tungstates; and c.) a smectite-type clay mineral being at least one selection from the group consisting of sauconite, beidellite, hectorite, nontronite, saponite, iron saponite, and stevensite, said clay minerals having a mean particle size of 20 to 500 nm;

wherein the mass ratio of water-soluble inorganic salt to smectite-type clay mineral is 1:1 to 1:0.01.

2. The waterborne composition of claim 1, further comprising a lubricating component comprising at least one selection from the group consisting of oils, soaps, metal soaps, waxes, and polytetrafluoroethylene, in an amount comprising 1-70 mass % of the sum of the water-soluble inorganic salt, smectite-type clay mineral, and lubricating component.

3. The waterborne composition of claim 1, wherein the water-soluble inorganic salt is at least one selection from the group consisting of sodium sulfate, potassium sulfate, sodium borate, potassium borate, ammonium borate, sodium silicate, potassium silicate, lithium silicate, ammonium molybdate, sodium molybdate, sodium tungstate, and sodium vanadate.

4. The waterborne composition of claim 1, wherein the smectite-type clay mineral is at least one selection from the group consisting of beidellite, hectorite, nontronite, saponite, iron saponite, and stevensite.

5. The waterborne composition of claim 1, wherein the smectite-type clay mineral is synthetic hectorite clay.

6. The waterborne composition of claim 1, further comprising a lubricating component comprising at least one selection from the group consisting of oils, soaps, metal soaps, waxes, and polytetrafluoroethylene, in an amount comprising 5-45 mass % of the sum of the water-soluble inorganic salt, smectite-type clay mineral, and lubricating component.

7. A waterborne composition for forming protective coatings comprising:

a.) water;

b.) at least one water-soluble inorganic salt selected from the group consisting of sulfates, molybdates, vanadates, and tungstates;

c.) a smectite-type clay mineral; and d.) a lubricating component comprising at least one selection from the group consisting of oils, soaps, metal soaps, waxes, and polytetrafluoroethylene, in an amount comprising 1-45 mass % of the sum of the water-soluble inorganic salt, smectite-type clay mineral, and lubricating component;

wherein the mass ratio of water-soluble inorganic salt to smectite-type clay mineral is 1:1 to 1:0.01.

8. The waterborne composition of claim 7, wherein the lubricating component comprises at least one selection from the group consisting of oils, soaps, metal soaps, and waxes in an amount comprising 5-45 mass % of the sum of the water-soluble inorganic salt, smectite-type clay mineral, and lubricating component.

9. A metal workpiece to be formed with a tool, the workpiece comprising a protective coating produced by applying and drying a composition according to claim 1 on the metal workpiece.

10. The metal workpiece according to claim 9, wherein the metal is iron, steel, copper, copper alloy, aluminum, aluminum alloy, titanium, titanium alloy, magnesium, magnesium alloy, tin, or tin alloy.

11. A method of forming a uniform protective coating on a metal workpiece to be formed with a tool, comprising the steps of:

a) degreasing a metal workpiece to be formed with a tool;

b) water-rinsing the metal workpiece;

c) applying a waterborne composition according to claim 1; and d) drying the composition on the workpiece.

12. The method of claim 11 wherein the waterborne composition further comprises a lubricating component comprising at least one selection from the group consisting of oils, soaps, metal soaps, waxes, and polytetrafluoroethylene, in an amount comprising 1-70 mass % of the sum of the water-soluble inorganic salt, smectite-type clay mineral, and lubricating component.

13. A method of forming a lubricant coating on a metal workpiece to be formed with a tool in the plastic working of metals comprising the steps of:

a) degreasing the metal workpiece b) water-rinsing the metal workpiece c) applying a waterborne composition according to claim 7; and d) drying the composition on the workpiece.

14. The method of claim 13 wherein the metal is iron, steel, copper, copper alloy, aluminum, aluminum alloy, titanium, titanium alloy, magnesium, magnesium alloy, tin, or tin alloy.

15. A waterborne composition comprising:

a.) water;

b.) a water-soluble inorganic salt; and c.) a smectite-type clay mineral being at least one selection from the group consisting of sauconite, beidellite, hectorite, nontronite, saponite, iron saponite, and stevensite, said clay minerals having a mean particle size of 20 to 500 nm;

wherein the mass ratio of water-soluble inorganic salt to smectite-type clay mineral is 1:1 to 1: 0.01.

* * * * *